United States Patent [19]

Neumaier

[11] Patent Number: 4,763,733

[45] Date of Patent: Aug. 16, 1988

[54] HAMMER DRILL WITH ROTATIONAL LOCK

[75] Inventor: Anton Neumaier, Fürstenfeldbruck, Fed. Rep. of Germany

[73] Assignee: Hilti Aktiengesellschaft, Liechtenstein

[21] Appl. No.: 921,957

[22] Filed: Oct. 20, 1986

[30] Foreign Application Priority Data

Oct. 26, 1985 [DE] Fed. Rep. of Germany ..... 3538166

[51] Int. Cl.[4] ..... B25D 11/04

[52] U.S. Cl. ..... 173/48; 173/109

[58] Field of Search ..... 173/47, 48, 109, 123; 74/22 A; 192/67 R, 65

[56] References Cited

U.S. PATENT DOCUMENTS

| | | | |
|---|---|---|---|
| 3,774,699 | 11/1973 | Schmuck | 173/48 |
| 3,834,468 | 9/1974 | Hettich et al. | 173/109 |
| 3,837,409 | 9/1974 | Consoli et al. | 173/109 |
| 3,845,826 | 11/1974 | Beisch | 173/48 |
| 4,236,588 | 12/1980 | Moldan et al. | 173/48 |

FOREIGN PATENT DOCUMENTS 0534036 4/1972 Switzerland .

*Primary Examiner*—E. R. Kazenske

*Assistant Examiner*—James L. Wolfe

*Attorney, Agent, or Firm*—Toren, McGeady & Associates

[57] ABSTRACT

A hammer drill can be switched between combined rotary and impact operation and impact operation. An electropneumatic mechanism provides the impact force and includes a guide cylinder with a beveled gear wheel extending around the outside surface of the cylinder. The gear wheel is driven by a drive wheel. A coupling sleeve is mounted on the guide cylinder for rotation with it and is axially displaceable relative to the cylinder between a first position in meshed engagement with the gear wheel and a second position displaced out of meshed engagement. A switching device moves the coupling sleeve between the two positions. In the first position, the coupling sleeve rotates the guide cylinder, while in the second position the guide cylinder is locked against rotation. The switching device includes a control cam engaged within a groove extending in the circumferential direction of the outside surface of the guide cylinder. In the second position of the coupling sleeve, the control cam is moved inwardly relative to the cylinder into one of a plurality of detent openings formed in the base of the groove for locking the guide cylinder so that it does not perform any rotary movement.

6 Claims, 2 Drawing Sheets

HAMMER DRILL WITH ROTATIONAL LOCK

BACKGROUND OF THE INVENTION

The present invention is directed to a hammer drill incorporating an electropneumatic impact mechanism including a guide cylinder or tube for transmitting rotational movement to a tool bit. A rotatable but not axially displaceable gear wheel is provided in permanent meshed engagement with a drive wheel arranged on the guide cylinder. A coupling sleeve is fitted on the guide cylinder so that it rotates with the cylinder, however, it is axially displaceable via a switching device located on the hammer drill housing. The coupling sleeve can be placed in meshed engagement with or disengagement from the gear wheel and the switching device is connected to the coupling sleeve.

In addition to percussion drills, hammer drills are often used for chiseling or cutting operations. In performing such chiseling operations, the rotational movement of the hammer drill is cut off so that the tool bit receives only axially directed blows. To prevent any unintentional rotation of the tool bit in the hammer drill, it has been known to lock the guide cylinder in a specific position. Depending on the type of tool bit holder used, a rotational lock of the guide cylinder is advantageous for use in changing the tool bit.

As a result, in a known hammer drill, an axially displaceable coupling sleeve is used on the guide cylinder or tube so that the sleeve does not rotate relative to the guide tube. The outside surface of the coupling sleeve has a polygonal shape. The switching device in engagement with the coupling sleeve is in the form of an eccentric shaft and serves, on one hand, for the axial displacement of the coupling sleeve, and, on the other hand, for the rotational locking of the coupling sleeve by bearing against one of the flat or planar faces of the polygonally shaped outside surface. Accordingly, the lockable rotational positions of this arrangement are limited by the polygonal shape of the coupling sleeve. If the outside surface of the sleeve forms a guadrilateral, then there are four different possible rotational positions. If the outside surface is a hexagon, then there are six different rotational positions. The number of flat sides of the polygonally shaped coupling sleeve cannot be increased in a random manner, since with an increase the contact surface for the eccentric shaft is shortened and effective rotational locking is not assured. Particularly where the chiseling operation is carried out at an inclined surface, it is advantageous if the attitude of the chisel bit is adapted to the position of the device which is optimal for the operator.

SUMMARY OF THE INVENTION

Therefore, it is the primary object of the present invention to provide a hammer drill which affords the locking of the guide cylinder in a plurality of positions.

In accordance with the present invention, the switching device includes a control cam displaceable perpendicularly to the direction in which the coupling sleeve can be displaced. The cam can be moved into a detent opening formed in the coupling sleeve.

Because the control cam can be moved or slid into the detent opening, it is possible to provide a positive locking connection between the coupling sleeve and the switching device. Incomplete locking due to wear phenomena is prevented and the absorption of high forces is assured. In addition, the spacing of the detent openings can be selected to correspond to the requirements of the hammer drill.

For displacing the coupling sleeve, the switching device is appropriately rotatable about an axis extending at right angles to the direction of displacement of the coupling sleeve and the control cam is formed as an eccentrically supported lug. With a switching device pivotally arranged at right angles to the displacement direction of the coupling sleeve, a large step-up ratio is afforded whereby higher switching forces can be applied with relatively small manual effort. If the end positions are suitably selected, no additional rotational locking of the device is required. It is preferable if the control cam is arranged as an eccentrically supported lug and can be provided with a conical shape, so that any possible play due to wear can be automatically compensated.

To afford a compact design, advantageously the detent opening is located in the base of a groove extending in the outside surface of the coupling sleeve. Accordingly, the control cam has two functions according to the present invention. In a first operational phase, the control cam merely engages into the groove and displaces the coupling sleeve in the axial direction. In a second operational phase, the control cam can be displaced radially inwardly into a detent opening in the base of the groove and thus afford a rotational lock for the coupling sleeve. If the control cam is lug shaped, the diameter of the detent opening corresponds to the width of the groove. Considerable vibrations can develop during the operation of a hammer drill. To prevent any accidental engagement or disengagement of the coupling sleeve or engagement or disengagement of the control cam, appropriately, protrusions and recesses are provided in the switching device and on the housing so that they can be placed in engagement with one another and serve for displacing the control cam at right angles to the displacement direction of the control sleeve in the disengaged state. Such protrusions and recesses can be formed as grooves and cams engaging in the grooves. The engagement of the protrusions in the recesses can be assured by means of spring elements.

For a better understanding of the present invention, reference is made to the following description and accompanying drawings, while the scope of the present invention will be pointed out in the appended claims.

DETAILED DESCRIPTION OF THE INVENTION

Figure 1:
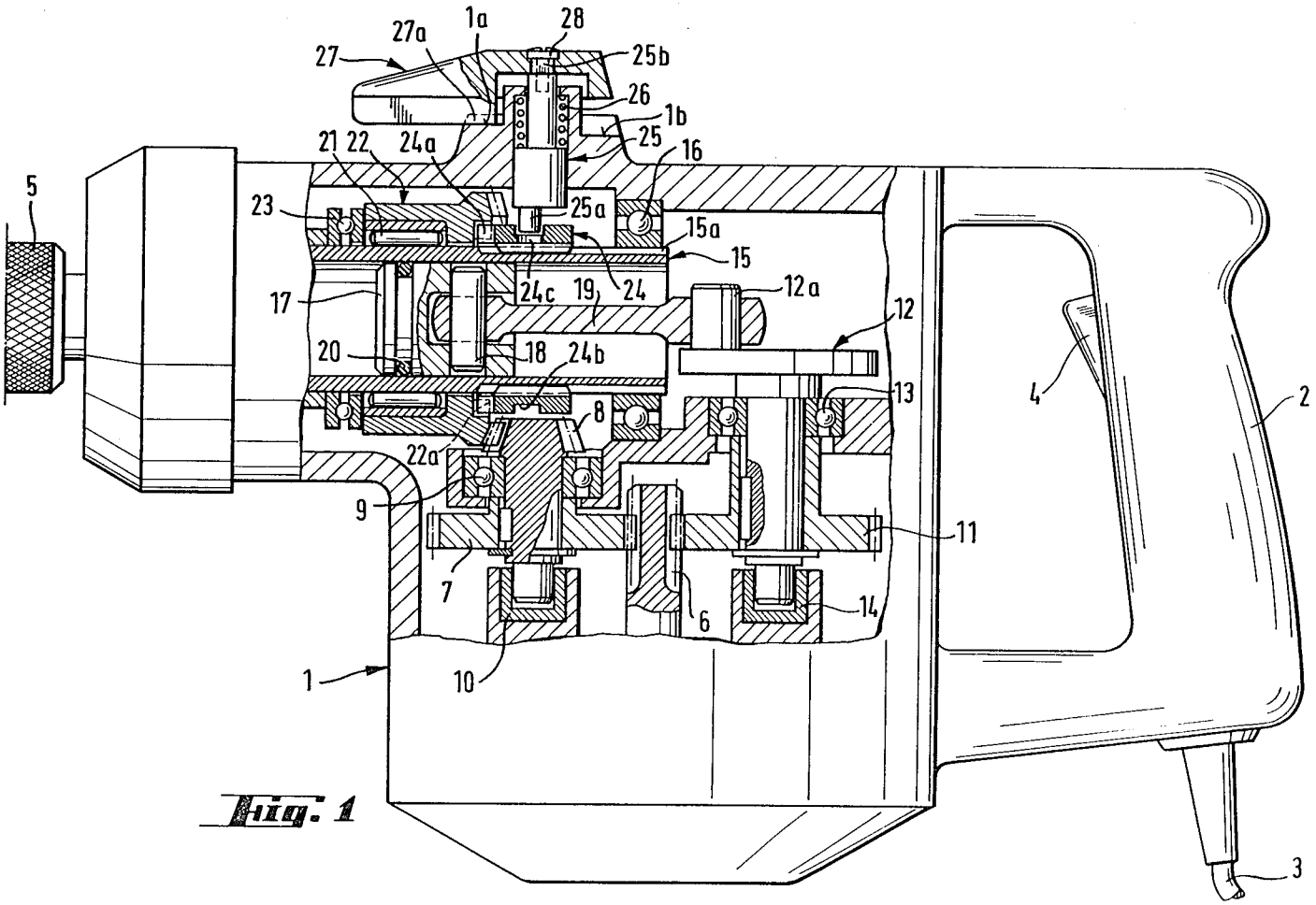
FIG. 1 is an elevational view, partly in section, of a hammer drill embodying the present invention and arranged in the impact drill mode.

In FIGS. 1 to 4, a hammer drill is illustrated including a housing 1. A handle 2 is connected to the housing 1, on the right hand side as viewed in FIG. 1. A current supply line 3 is connected to the handle 2. Push button or trigger 4 is located in the handle 2 for switching the hammer drill between on and off. At the left hand end in FIG. 1, a tool holder 5 is shown in part projecting outwardly from the housing 1. The drilling direction extends horizontally through the housing and through the tool holder 5. Within the housing 1 a motor pinion 6 is provided in meshed engagement with a spur wheel 7. Spur wheel 7 is connected to a conical or beveled pinion 8 so that the two rotate as a unit. The beveled pinion 8 is supported in a ball bearing 9, located between the spur wheel 7 and the beveled pinion 8 and in a bearing bush 10 located below the spur wheel. As viewed in FIG. 1, in addition to its meshed engagement with the spur wheel 7, the motor pinion 6, on the opposite side from the spur wheel, is in meshed engagement with a second spur wheel 11. The second spur wheel 11 extends upwardly and is connected with a crankshaft 12. The second spur wheel 11 and the crankshaft 12 are supported in a ball bearing 13 and in a bearing bush 14 located at the lower end of the second spur gear. A guide cylinder 15 has its axis extending in the drilling direction and is supported at its rear end, that is the end closer to the handle 2, in a radial ball bearing 16. An exciter piston 17 is slidably displaceably guided in the guide cylinder 15. The exciter piston 17 is connected by a piston pin 18 to a connecting rod 19 with the connecting rod extending rearwardly from the piston and secured to a crank pin 12*a* mounted eccentrically on the crankshaft 12. A sealing ring 20 encircles the exciter piston 17 at its forward end, that is the end closer to the tool holder. A beveled gear 22 encircles and is rotatably supported on the guide cylinder 15 by a needle roller bearing 21. The beveled gear 22 is in permanent meshed engagement with the beveled pinion 8. At its forward end, the beveled gear 22 abuts against a ball bearing 23 extending around the guide cylinder 15.

Guide cylinder 15 has splines 15*a* on its outside surface extending from its rear end for a portion of its axial length. A coupling sleeve 24 encircles the guide cylinder 15 and its inner surface is similarly splined for engagement with the splines 15*a* on the guide cylinder. The end of the coupling sleeve 24 closer to the gear wheel 22 has claw or teeth-like members 24*a* which can be placed in meshed engagement with a set of teeth 22*a* on the gear wheel 22. A groove 24*b* extends in the circumferential direction around the coupling sleeve between its ends and a plurality of detent openings 24*c* extend radially inwardly from the base of the groove 24*b*. A switching device 25 is supported on the housing 1 and rotates about an axis extending perpendicularly to the drilling direction or the direction of displacement of the coupling sleeve. Switching device 25 includes a control cam 25*a* extending downwardly into the groove 24*b* in the coupling sleeve 24 and the cam is biased downwardly by a spring 26, that is, it is biased toward the guide cylinder 15. At the radially outer or upper end of the switching device 25 there is an actuation member 27. The actuation member 27 is connected with the switching device 25 by polygonally shaped section 25*b* and by a screw 28. The actuation member 27 has a elongated projection 27*a* located on the lower side of the member extending toward the housing 1. The housing 1 has a detent groove 1*a* on the forward side of the switching device 25 and a recess 1*b* on the rear side of the switching device. The projection 27*a* engages in the detent groove 1*a* or in the recess 1*b*.

As displayed in FIG. 1, the projection 27*a* is located within the detent groove 1*a*. As a result, the control cam 25*a* on the lower end of the switching device 25 projects downwardly into the groove 24*b* of the coupling sleeve 24, but not into one of the detent openings. In the position of FIG. 1, the rotational movement is transferred from the beveled pinion 8 to the beveled gear 22 and then from the beveled gear 22 to the coupling sleeve 24 which rotates the guidance cylinder 15.

When the actuation member 27 is pivoted 180° about the axis of the switching device 25, the eccentric arrangement of the control cam 25*a* displaces the coupling sleeve 24 rearwardly toward the handle or toward the ball bearing 16. The teeth-like members 24*a* on the coupling sleeve 24 move out of engagement with the corresponding teeth on the gear wheel 22. Accordingly, the transmission of rotational movement to the drive cylinder 15 is interrupted. When the actuation member 27 is turned about the axis of the switching device 25, its projection 27*a* moves into the recess 1*b* which is deeper than the detent groove 1*a*, note FIG. 2. As a result, the control cam 25*a* on the switching device 25 enters into one of the detent openings 24*c* and the guide cylinder 15 is locked against any rotational movement by the coupling sleeve 24.

Figures 2, 3, 4:
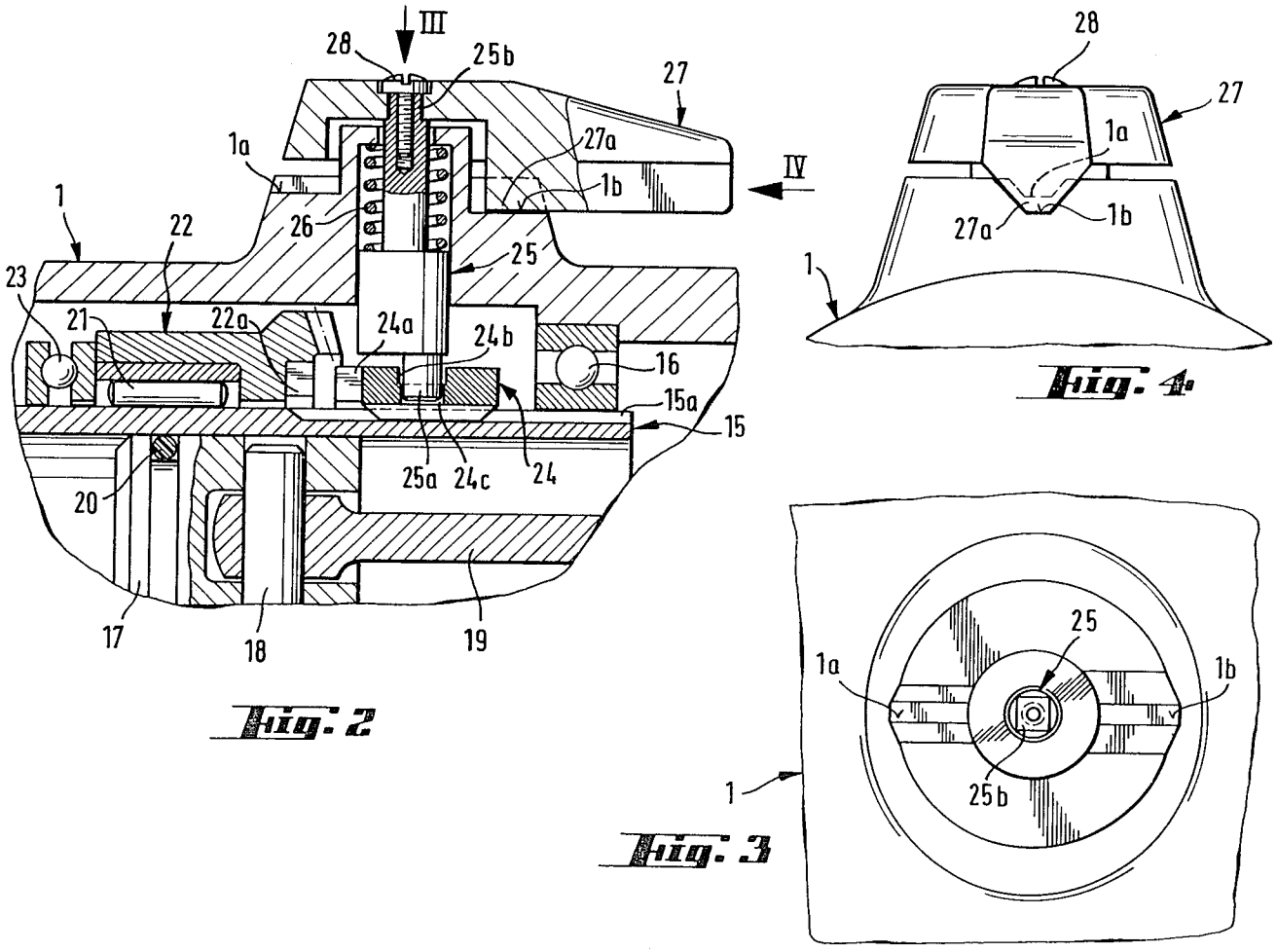
FIG. 2 is an enlarged partial view of the hammer drill shown in FIG. 1 with the hammer drill secured for "impact only" operation.
FIG. 3 is a plan view of a portion of the hammer drill shown in FIG. 2 taken in the direction of the arrow III with the switching lever removed.
FIG. 4 is an elevational view of the hammer drill shown in FIG. 2 taken in the direction of the arrow IV.

In the plan view of the housing 1 set forth in FIG. 3, with the actuation member 27 removed, the detent groove 1*a* and the recess 1*b* are located diametrically opposite one another relative to the switching device 25.

FIG. 4 illustrates the manner in which the projection 27*a* fits into the recess 1*b*. When the actuation member 27 is pivoted, it is lifted by the obliquely disposed flanks of the projection 27*a* and the corresponding sides of the recess 1*b* so that the projection 27*a* is lifted upwardly out of the recess 1*b*.

While specific embodiments of the invention have been shown and described in detail to illustrate the application of the inventive principles, it will be understood that the invention may be embodied otherwise without departing from such principles.

I claim:

1. A hammer drill comprising a housing with a drilling axis, an electropneumatic impact mechanism including a hollow guide cylinder located within said housing and having an axis parallel with the drilling axis, said guide cylinder having an axially extending inside surface and outside surface, means within said housing for driving said impact mechanism, an annular gear wheel mounted on the outside surface of said guide cylinder so as to be rotatable relative to said guide cylinder and to be secured against axial displacement relative to said guide cylinder, a drive wheel in permanent meshed engagement with said gear wheel for rotating said gear wheel, a coupling sleeve mounted on the outside surface of said guide cylinder and being rotatable with and axially displaceable relative to said guide cylinder, a switching device located on said housing and engageable with said coupling sleeve for moving said coupling sleeve axially between a first position in meshed engagement with said gear wheel and a second position out of meshed engagement with said gear wheel, wherein the improvement comprises that said switching device includes an axially extending control cam with the axis thereof disposed substantially perpendicularly to the drilling axis, said control cam being axially displaceable when moving said coupling sleeve between the first and second positions, said coupling sleeve having at least one detent opening therein alignable with said control cam so that said control can be inserted into the detent opening when said coupling sleeve is in the second position affording a locking action, said switching device being rotatable about an axis disposed perpendicularly to the direction of displacement of said coupling sleeve, and said control cam comprises a lug disposed eccentrically relative to the rotational axis of said switching device.

2. Hammer drill, as set forth in claim 1, wherein a groove is formed in and extends around the circumference of said coupling sleeve, said groove having a base spaced inwardly from the outside surface of said coupling sleeve, and said detent opening being located in the base of said groove and extending radially inwardly from the base of said groove.

3. Hammer drill, as set forth in claim 1, wherein said switching device includes an actuation member for rotating said switching device, said housing having recesses in the outside surface thereof and including a first recess located on one side of said switching device and a second recess located on the diametrically opposite side of said switching device, said actuation member having a projection extending into said first recess in the first position of said coupling sleeve and extending into said second recess in the second position of said coupling sleeve, said second recess extending inwardly from the outside surface of said housing for a greater depth than said first recess so that in said first recess the control cam on the switching device extends inwardly only as far as the base of said groove and with said projection in said second recess said control cam extends radially inwardly of the base of said groove into said detent opening.

4. Hammer drill, as set forth in claim 3, wherein a plurality of said detent openings are formed in said groove spaced apart in the circumferential direction of said coupling sleeve.

5. A hammer drill comprising a housing with a drilling axis, an electropneumatic impact mechanism including a hollow guide cylinder located within said housing and having an axis parallel with the drilling axis, said guide cylinder having an axially extending inside surface and outside surface, means within said housing for driving said impact mechanism, an annular gear wheel mounted on the outside surface of said guide cylinder so as to be rotatable relative to said guide cylinder and to be secured against axial displacement relative to said guide cylinder, a drive wheel in permanent meshed engagement with said gear wheel for rotating said gear wheel, a coupling sleeve mounted on the outside surface of said guide cylinder and being rotatable with an axially displaceable relative to said guide cylinder, a switching device located on said housing and engageable with said coupling sleeve for moving said coupling sleeve axially between a first position in meshed engagement with said gear wheel and a second position out of meshed engagement with said gear wheel, wherein the improvement comprises that said switching device includes an axially extending control cam with the axis thereof disposed substantially perpendicularly to the drilling axis, said control cam being axially displaceable when moving said coupling sleeve between the first and second positions, said coupling sleeve sleeve having at least one detent opening therein alignable with said control cam so that said control cam can be inserted into the detent opening when said coupling sleeve is in the second position affording a locking action, said switching device being rotatable about an axis disposed perpendicularly to the direction of displacement of said coupling sleeve, said control cam comprises a lug disposed eccentrically relative to the rotational axis of said switching device, said coupling sleeve has a radially inner circumferentially extending surface and a radially outer circumferentially extending surface relative to the drilling axis, an annular groove is formed in and extends around the radially outer surface of said coupling sleeve, said groove having a base spaced radially inwardly from the radially outer surface of said coupling sleeve, and said detent opening being located in the base of said groove and extending radially inwardly from the base of said groove toward the radially inner surface of said coupling sleeve so that in the second position said control cam enters said detent opening radially inwardly of the base of said groove.

6. Hammer drill, as set forth in claim 5, wherein said switching device includes an actuation member for rotating said switching device, said housing having recesses in the outside surface thereof and including a first recess located on one side of said switching device and a second recess located on the diametrically opposite side of said switching device, said actuation member having a projection extending into said first recess in the first position of said coupling sleeve and extending into said second recess in the second position of said coupling sleeve, said second recess extending inwardly from the outside surface of said housing for a greater depth than said first recess so that in said first recess the control cam on the switching device extends inwardly only as far as the base of said groove and with said projection in said second recess said control cam extends radially inwardly of the base of said groove into said detent opening.

* * * * *